US009212504B1

(12) United States Patent
Mobile, Sr.

(10) Patent No.: US 9,212,504 B1
(45) Date of Patent: Dec. 15, 2015

(54) FENCE POST SYSTEM, CONSTRUCTION, AND METHOD

(71) Applicant: Raymond A. Mobile, Sr., Crystal Lake, IL (US)

(72) Inventor: Raymond A. Mobile, Sr., Crystal Lake, IL (US)

( * ) Notice: Subject to any disclaimer, the term of this patent is extended or adjusted under 35 U.S.C. 154(b) by 0 days.

(21) Appl. No.: 14/483,861

(22) Filed: Sep. 11, 2014

Related U.S. Application Data

(63) Continuation-in-part of application No. 14/297,391, filed on Jun. 5, 2014, now abandoned.

(51) Int. Cl.
*E04H 17/10* (2006.01)
*E04H 17/14* (2006.01)

(52) U.S. Cl.
CPC ..... *E04H 17/14* (2013.01)

(58) Field of Classification Search
CPC ..... E04H 17/10; E04H 17/12
USPC ..... 256/1, 32, 34, 45, 47, 48, 50, 52, 53, 256/58; 254/131, 132
See application file for complete search history.

(56) References Cited

U.S. PATENT DOCUMENTS

| | | | | | |
|---|---|---|---|---|---|
| 429,935 | A * | 6/1890 | Miles | 52/676 |
| 536,956 | A * | 4/1895 | Jones et al. | 256/36 |
| 580,847 | A * | 4/1897 | Clark | 256/53 |
| 683,800 | A * | 10/1901 | Reavis | 52/356 |
| 759,488 | A * | 5/1904 | Van Meter | 256/50 |
| 867,037 | A * | 9/1907 | Hargis | 256/57 |
| 987,639 | A * | 3/1911 | Meyer | 256/57 |
| 1,004,859 | A * | 10/1911 | Dowd | 52/349 |
| 1,023,880 | A * | 4/1912 | Rubeck | 256/53 |
| 1,399,426 | A * | 12/1921 | Harding | 52/165 |
| 1,455,711 | A * | 5/1923 | Collins | 52/356 |
| 1,479,291 | A * | 1/1924 | Evans | 256/57 |
| 1,484,949 | A * | 2/1924 | Kitselman et al. | 256/58 |
| 1,714,388 | A * | 5/1929 | McBride | 256/52 |
| 1,795,544 | A * | 3/1931 | Eisenmann | 256/48 |
| 2,029,739 | A * | 2/1936 | Pavek | 256/52 |
| 2,364,419 | A * | 12/1944 | Barnes | 256/58 |
| 2,994,510 | A * | 8/1961 | Michalak | 254/30 |
| 3,776,522 | A * | 12/1973 | Bartlett | 256/47 |
| 4,503,636 | A * | 3/1985 | Stuckey | 47/44 |
| 5,464,192 | A * | 11/1995 | Burnham | 254/30 |
| 5,681,030 | A * | 10/1997 | Nall | 254/30 |
| D395,528 | S * | 6/1998 | Mayer et al. | D25/131 |
| 5,816,192 | A * | 10/1998 | van der Lely et al. | 119/57.92 |
| 6,978,983 | B1 * | 12/2005 | Sclease et al. | 254/30 |
| 7,823,350 | B2 * | 11/2010 | Valle et al. | 52/356 |
| 8,540,217 | B2 * | 9/2013 | Olsson et al. | 256/48 |
| 2003/0126794 | A1 * | 7/2003 | Wisniewski | 47/47 |
| 2004/0094754 | A1 * | 5/2004 | Carmouche | 254/131 |

* cited by examiner

*Primary Examiner* — Daniel Wiley
(74) *Attorney, Agent, or Firm* — Meroni & Meroni, P.C.; Charles F. Meroni, Jr.

(57) ABSTRACT

A fence post construction provides a method for notch-supporting mesh fencing. The fence post construction is constructed from a load-bearing material and has a post axis, an upper post end, and a lower post end. The material construction is formed to include laterally opposed wing portions extending outwardly relative to the post axis, each of which preferably include a series of laterally paired notch arrangements. Each notch arrangement is T-shaped, and provide an upper notch portion, a lower notch portion collinear with the upper notch portion, a stem notch portion orthogonal to the upper and lower notch portions, a downwardly extending upper wing arm, and an upwardly extending lower wing arm. the lower notch portion and lower wing arm are preferably at least twice the length of the upper notch portion and upper wing arm relative to the stem portion.

15 Claims, 9 Drawing Sheets

FENCE POST SYSTEM, CONSTRUCTION, AND METHOD

PRIOR HISTORY

This patent application is a Continuation-in-Part patent application claiming the benefit of pending U.S. patent application Ser. No. 14/297,391 filed in the United States Patent and Trademark Office on 5 Jun. 2014.

BACKGROUND OF THE INVENTION

Field of the Invention

The present invention relates generally to a fence post construction for supporting fencing materials. More particularly, the present invention relates to a fence post construction for notch-receiving and supporting mesh type fencing materials.

SUMMARY OF THE INVENTION

The fence post construction according to the present invention is primarily intended to mate with mesh type fence constructions, providing the ability to secure, lock or integrate the mesh fence construction with the fence post construction without using any separate mating components such as zip ties, wire, or fasteners. To achieve these and other readily apparent objectives, the present invention essentially discloses a notched or slotted fence post construction for supporting mesh type fencing. The fence post construction according to the present invention preferably comprises or is constructed from a load bearing material and has a post axis, an upper post end, and a lower post end.

The load bearing material is preferably formed to comprise laterally opposed wing portions that extend outwardly relative to the post axis, each of which laterally opposed wing portions preferably comprises at least one notch or slot arrangement. The fence post construction is insertable into a ground surface via the lower post end such that the post axis extends in non-parallel or preferably or ideally orthogonal relation to the ground surface. A mesh fence construction is thereby attachable to the fence post construction via notch or slot arrangements.

The notch arrangements are preferably laterally and spatially paired, and spatially located or situated adjacent at least a select post end, the select post end being selected from the group consisting of the upper post end and the lower post end. The load bearing material is further preferably formed so as to comprise a medial post portion, which medial post portion interconnects the laterally opposed wing portions. The medial post portion may preferably transversely interconnect the laterally opposed wing portions non-linearly.

In this last regard, it is contemplated that the laterally opposed wing portions extend in a wing plane and the medial post portion may preferably comprise a two-portion structure or form. The two portions or structures or formations of the two-portion structure or form extend in a portion plane, which portion planes together with the wing plane preferably define a transversely triangular configuration via the planar junction sites thereof. The triangular configuration may preferably comprise an interior angle of 90 degrees.

The primary fence post construction, when juxtaposed adjacent at least one secondary, identical fence post construction, is horizontally stackable therewith such that an upper medial post portion may seat down upon a lower medial post portion within the stack. The transversely triangular configurations of the fence post constructions effectively operate to center the upper medial post portion(s) upon the lower medial post portion(s).

Each notch or slot arrangement is characteristically and preferably T-shaped. The T-shaped notch or slot arrangements thereby provide a downwardly extending upper wing arm and an upwardly extending lower wing arm. The load bearing material of the fence post construction may preferably comprise a sufficient gauge or thickness to enable the user to manually (i.e. with one's finger or proper tool or implement) bend a select wing arm to lock intertwined linkages of the mesh type fence to the fence post construction(s), the select wing arm being selected from the group consisting of the upper and lower wing arms.

The T-shaped notch or slot arrangements each further preferably comprise an upper notch portion, a lower notch portion collinear with the upper notch portion, and a stem notch portion orthogonal to the upper and lower notch portions. The lower notch portion is preferably at least twice the length of the upper notch portion relative to the stem portion. The upper and lower notch portions each further preferably comprise a substantially uniform notch width and the stem portion comprises a stem opening width, wherein the stem opening or entry width is preferably greater than the notch width.

Further, it is contemplated that the structures described herein inherently support certain fence posting methodology for post-supporting mesh fencing, and thus it is believed that certain fence posting methods are supported by the following specifications. The fence posting methodology may be said to preferably comprise the initial step of providing at least one fence post construction, the fence post construction comprising a post axis, an upper post end, a lower post end, and at least one notched arrangement. The at least one wing portion is then into a ground surface via the post lower end such that the post axis extends in non-parallel relation to the ground surface; and a mesh fence construction is attachable to the at least one fence post construction via the notched arrangement.

Each notch arrangement may be preferably T-shaped such that the T-shaped notch arrangements thereby further provide a downwardly extending upper wing arm and an upwardly extending lower wing arm. The mesh fence construction is thus attachable to the at least one fence post construction via an engagement with the upper and lower wing arms. The method may be said to further comprise the step of bending a select wing arm to lock intertwined linkages of the mesh fence construction to the at least one fence post construction, the select wing arm being selected from the group consisting of the upper and lower wing arms. Still further, the fence posting method may be said to comprise the steps of (a) actuating intertwined linkages of the mesh fence construction and (b) relaxing intertwined linkages of the mesh fence construction during the step of attaching the mesh fence construction to the at least one fence post construction via the notched arrangement.

BRIEF DESCRIPTION OF THE DRAWINGS

Other features of my invention will become more evident from a consideration of the following brief descriptions of patent drawings.

DETAILED DESCRIPTION OF THE PREFERRED EMBODIMENTS AND ASSOCIATED METHODOLOGY

Figure 1:
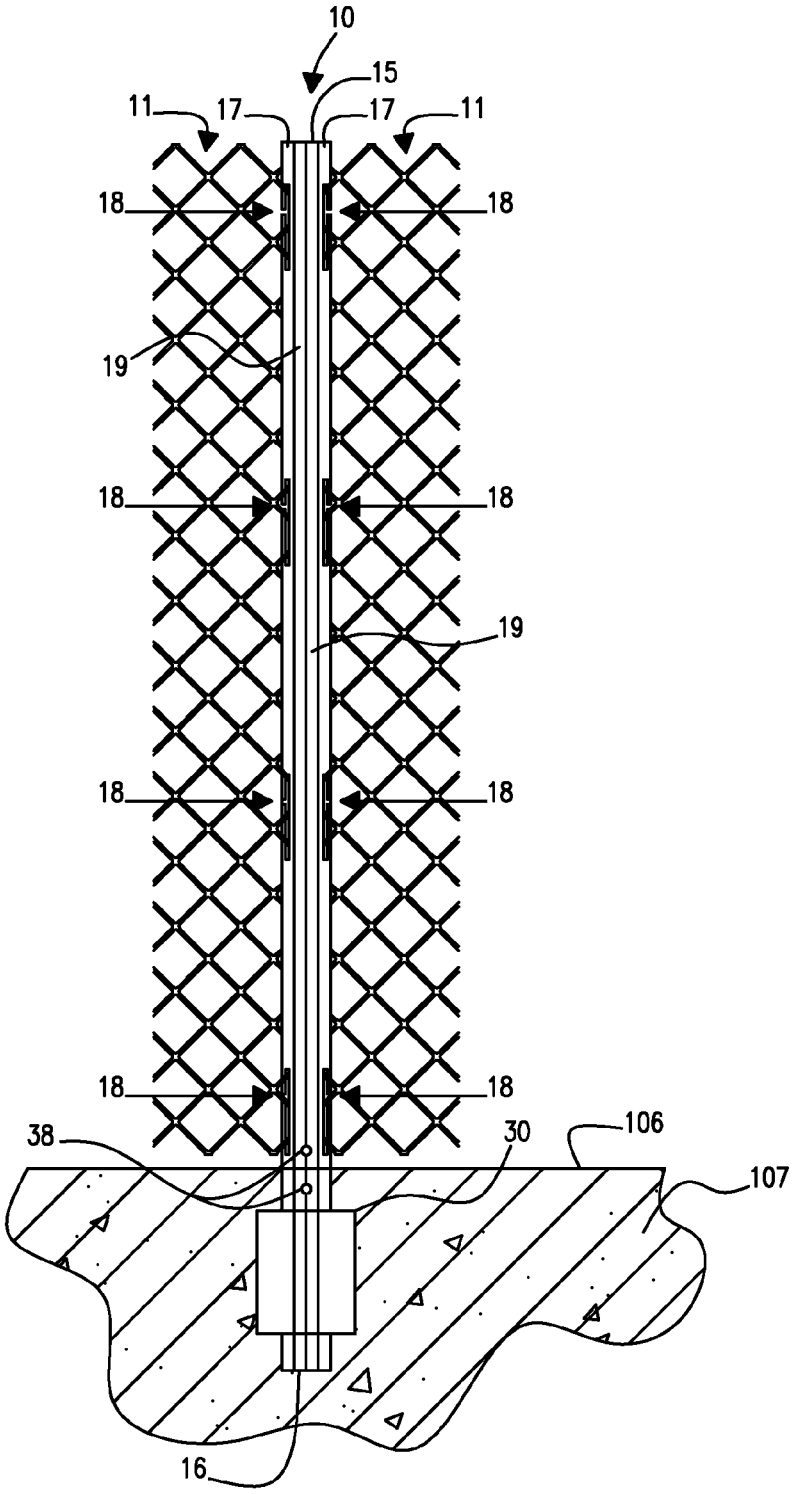
FIG. 1 is an elevational view of a fence post construction according to the present invention with a fragmentary mesh fence construction attached thereto, and depicting the fence post construction in a condition of use, namely, having been inserted into a fragmentary cross-section of ground material.
Figure 2:
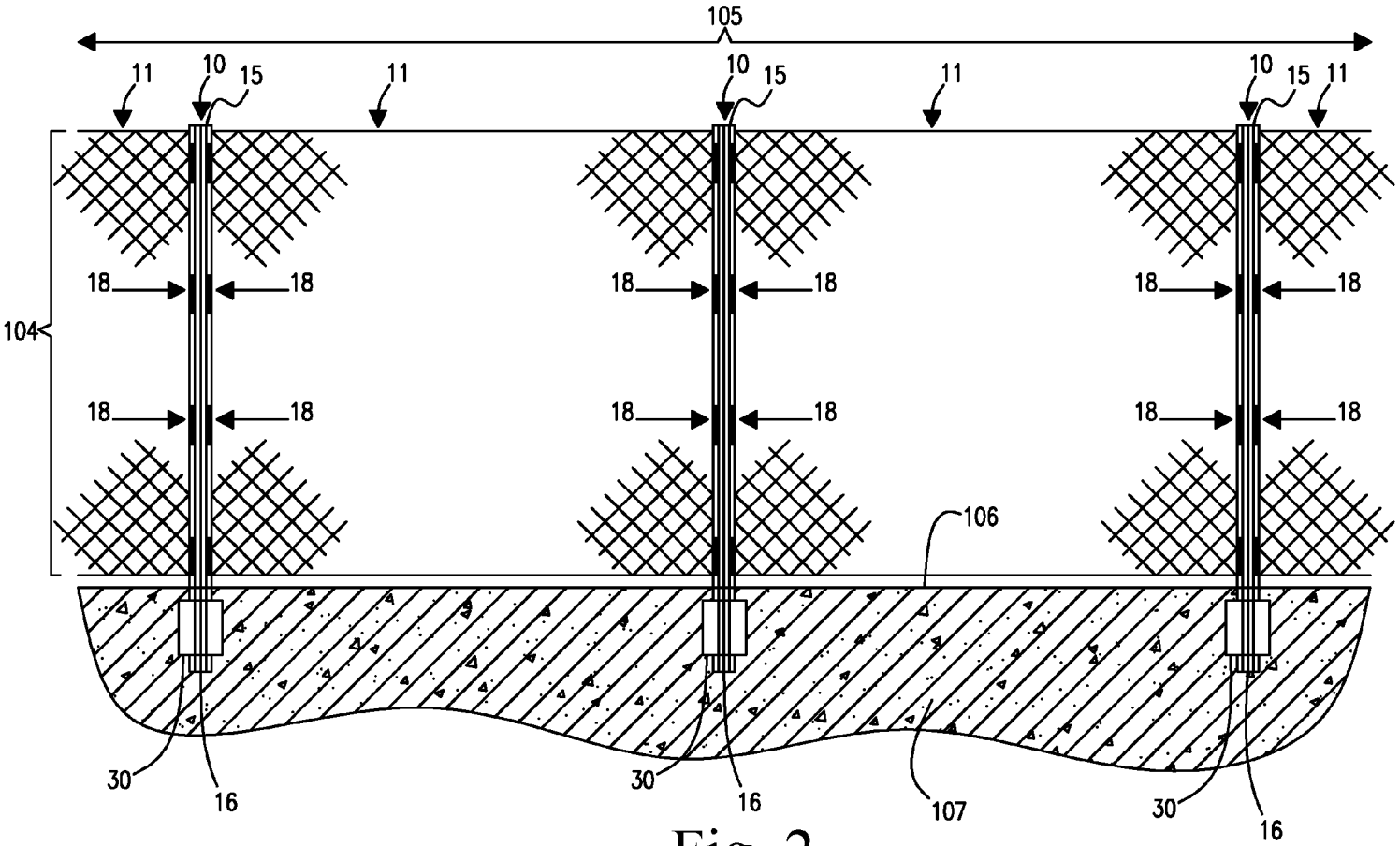
FIG. 2 is an elevational view of a series of fence post constructions according to the present invention with a fragmentary mesh fence construction attached thereto, and depicting the series of fence post constructions in a condition of use, namely, having been inserted into a fragmentary cross-section of ground material.

Referring now to the drawings with more specificity, the preferred embodiments of the present invention primarily concern a fence post construction usable systemically and with associated fencing methods for providing enhanced means for post-supporting, or more particularly, notch-supporting mesh type fencing materials at a fence site as generally depicted in FIG. 2. When viewed systemically, the fence post system preferably comprises, in combination, a plurality of fence post constructions 10 according to the present invention, and a (state of the art) mesh fence construction as at 11. FIGS. 8-11 depict a variety of alternative mesh fence constructions usable in combination with the fence post construction(s) 10 as further exemplified and comparatively referenced at 12, 13, and 14.

Each fence post construction 10 according to the present invention preferably comprises or is constructed or formed from a load bearing material such as mild carbon steel, which can vary in thicknesses from 0.048 inch (0.122 cm) nominal thickness to 0.112 inch (0.284 cm) nominal thickness. The fence post construction 10 further comprises a post axis as at 100, an upper post end as at 15 and a lower post end as at 16. The load bearing material is preferably formed to comprise at least one, but preferably laterally opposed wing portions as at 17. The wing portions 17 extend outwardly relative to the post axis 100. Each wing portion 17 preferably comprises at least one, but preferably laterally opposed or spatially paired notch arrangements as generally depicted and referenced at 18.

The raw material exemplified by mild carbon steel may be hot-rolled or cold-rolled, and hot-dipped galvanized. The fence post constructions 10 begin as flat stock preferably 2.312 inches (5.872 cm) in width and may range from 48 inches (≈122 cm) to 96 inches (≈244 cm) in length depending on the application, noting that primary or preferred applications typically require 48 to 72 inch lengths. The fence post constructions 10 are preferably formed via a two-step process or operation. The first operation is a notching or slotting operation, and the second operation is a bending or forming operation.

During the notching or slotting operation, the notches or slots 18 may be preferably formed in the flat via a 75 ton OBI Punch Press. Although the number of notches 18 may differ, the preferred number of notches 18 is 4 per wing portion 17 spaced evenly from the upper post end 15 to the lower post end 16 starting from 2 inches from the upper post end 15 and spaced 9 inches between each notch 18. The paired notch arrangements are preferably spatially located at minimum adjacent a select post end, the select post ends being selected from the group consisting of the upper post ends 15 and the lower post ends 16.

Figure 12:
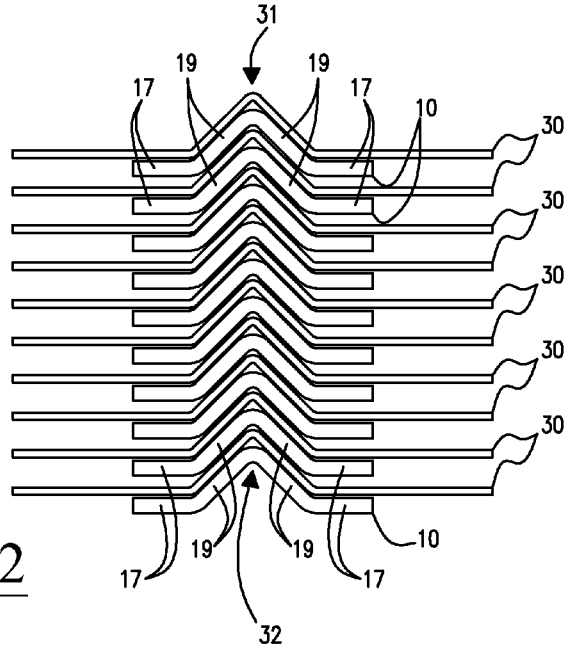
FIG. 12 is an end view of a series of stacked fence constructions according to the present invention, the view being presented to show the general transverse, nestable shape of the fence construction(s).
Figure 14:
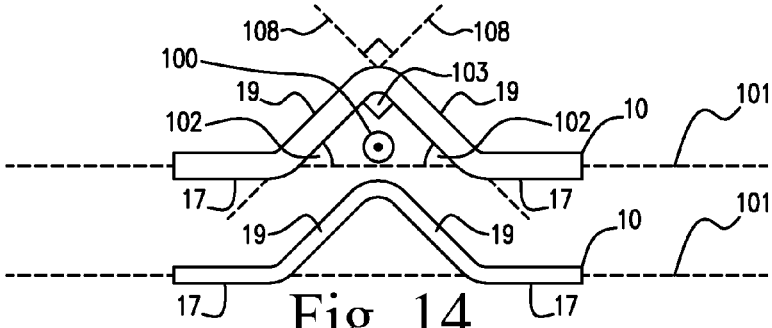
FIG. 14 is an end view of an upper relatively heavier gauge fence post construction juxtaposed in superior adjacency to a lower, relatively lighter gauge fence post construction.

During the forming operation, the notched flat is inserted into a 200 ton Hydraulic Press, and the V-shaped transverse form generally depicted in FIGS. 12 and 14 is stamp-formed via a single hit from said press with two medial forms or portions 19 are formed at 45 degree angles as at 102 relative to the wing portion plane or plane 101 of the wing portions 17 thereby preferably forming a 90 degree angle as at 103. In other words, the load bearing material is formed so as to comprise a medial post portion, which medial post portion interconnects the laterally opposed wing portions 17, the medial post portion may be thought of as consisting of the medial portions 19 transversely interconnecting the laterally opposed wing portions 19 non-linearly.

The laterally opposed wing portions 17 preferably extend in a wing plane 100, and the medial post portion 19 preferably comprises a two-portion structure (e.g. two medial portions 19), each of which extend in a portion plane 108. Referencing FIG. 14, it will be seen that the portion planes 108 and the wing plane 101 together define a transversely triangular configuration via the planar junction sites thereof. The triangular configuration preferably comprises an interior angle of 90 degrees as at angle 103.

The mesh fence construction 11, for example, (or 12, 13, or 14 for further example) usable in combination with the fence post construction(s) 10 according to the present invention preferably comprises a mesh height (or width) as at 104, a mesh length as at 105, and a series of intertwined linkages as at 21 (or 22, 23, or 24). The intertwined linkages 21 (or 22, 23, or 24) together respectively define a number of openings as generically and comparatively depicted at reference numeral 20 across the exemplary embodiments 11, 12, 13, and 14 in FIGS. 8-11. It is contemplated that the preferred mesh fence material construction may be resilient polyethylene, plastic, nylon, or similar other polymeric materials, and alternatively may be metallic based, such as chicken wire, welded wire mesh, and chain link type fencing.

The fence post constructions 10 are insertable into a post-anchoring material (e.g. earth 107) via an anchor surface as exemplified by a ground or earthen surface 106 in spaced relation to one another via the post lower ends 16 (optionally outfitted with an anchor plate 30 spot-welded or otherwise fastened to the fence post construction 10) such that the post axes 100 extend in non-parallel or ideally orthogonal relation to the ground surface 106.

The mesh fence construction as exemplified by construction 11 is attachable to the fence post constructions 10 in spaced relation along the mesh length 105 as generally depicted in FIG. 2. Select intertwined linkages 11 are received and secured by the notch arrangements 18 such that the mesh width 104 extends in substantially parallel relation to the post axes 100. Together the fence post constructions 10 and the (select) mesh fence construction 11 thereby provide securely (post-) supported mesh fencing materials.

Figure 3:
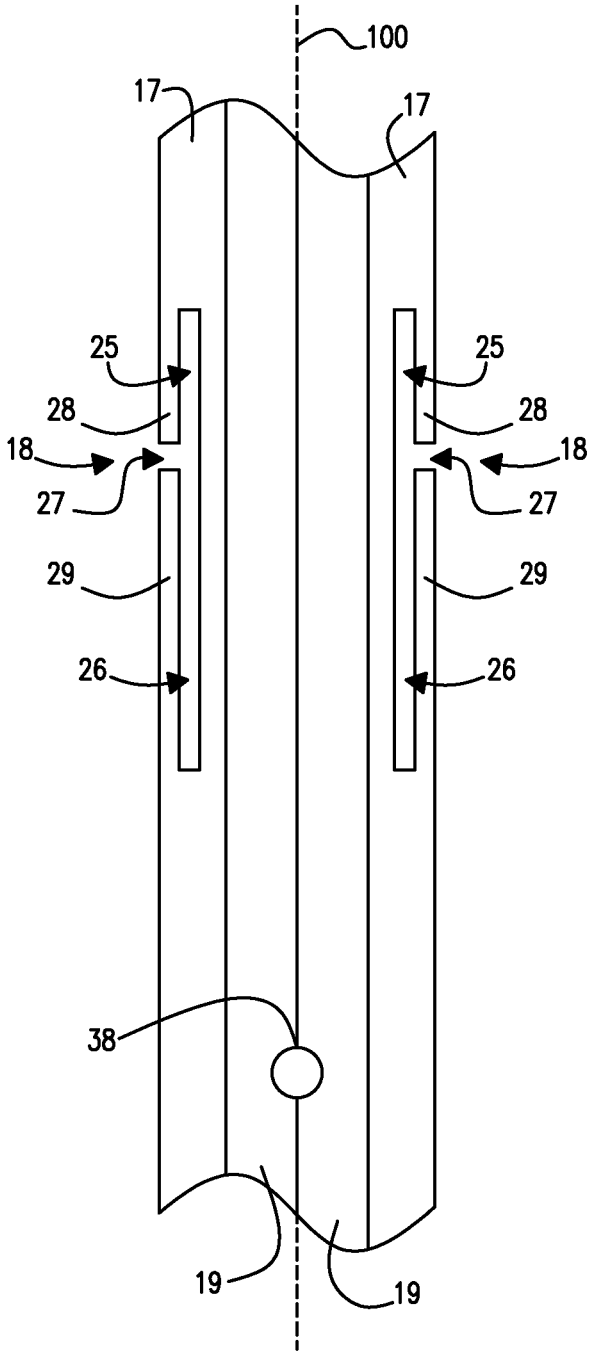
FIG. 3 is a first enlarged, fragmentary, elevational view of a fence post construction at a notch or slot arrangement site of the fence post construction, the view being presented for greater clarity of the structural relationships of the notched or slotted arrangement(s) and associated features.

It is contemplated that the notch or slot arrangements 18 are central to the practice of the present invention. In this regard, and referencing FIG. 3, in particular, the reader will please note that each notch arrangement is preferably T-shaped thereby providing (a) an upper notch portion as at 25; (b) a lower notch portion as at 26, which lower notch portion 26 is collinear or coextensive with the upper notch portion 25; (c) a stem notch portion as at 27 orthogonal to the upper and lower notch portions 25 and 26; (d) a downwardly extending upper wing arm as at 28; and (e) an upwardly extending lower wing arm as at 29.

The lower notch portion 26 is preferably at least twice the length of the upper notch portion 25 relative to the stem portion 27. In this regard, and more particularly, excellent results have been achieved when providing (a) lengths of the upper notch portion 25 and upper wing arm 28 on the order of 1 inch (2.54 cm) and (b) widths of the upper and lower notch portions 25 and 26 and upper and lower wing arms on the order of 0.15 inches (0.38 cm). The lengths of the lower notch portion 26 and the lower wing arm 29 are preferably on the order of 2.25 inches. The entry width of the stem portion 27 is preferably on the order of 0.2 inches (0.51 cm) and the length of the stem portion is on the order of 0.15 inches. The overall width of each wing portion is preferably on the order of 0.5 inches (1.27 cm).

It will thus be seen that the upper and lower notch portions 25 and 26 each preferably comprise a substantially uniform notch width and that the stem portion 27 preferably comprises a stem opening or entry width, which stem opening or entry width is preferably greater than the notch width. Recalling that the load bearing material may preferably comprise varied thicknesses, it is contemplated that the material construction may comprise a sufficient gauge or thickness to enable the user to manually bend (as at 109) a select wing arm to lock the intertwined linkages as at 21 of the mesh fence construction 11 to the fence post constructions 10 as generally and comparatively depicted in FIGS. 17 and 18. The select wing arm may be preferably selected from the group consisting of the upper and lower wing arms 28 and 29.

Figures 15, 16, 17, 18:
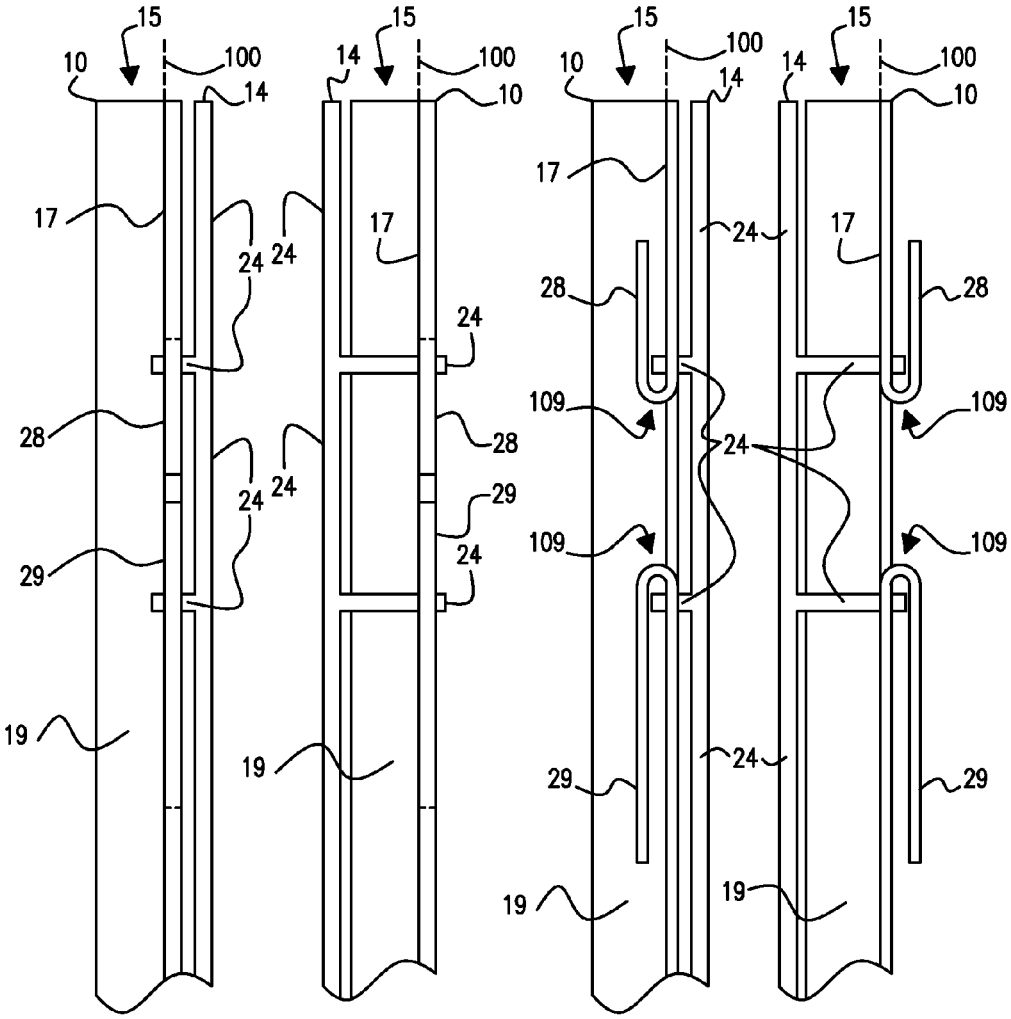
FIG. 15 is a fragmentary side view of an upper end of a relatively heavier gauge fence post construction according to the present invention with a mesh fence construction being attached to the fence post construction at an upper notch arrangement in posterior adjacency to the fence post construction.
FIG. 16 is a fragmentary side view of an upper end of a relatively heavier gauge fence post construction according to the present invention with a mesh fence construction being attached to the fence post construction at an upper notch arrangement in anterior adjacency to the fence post construction.
FIG. 17 is a fragmentary side view of an upper end of a relatively lighter gauge fence post construction according to the present invention with a mesh fence construction being attached to the fence post construction at an upper notch arrangement in posterior adjacency to the fence post construction with wing arms being bent to lock the mesh fence construction to the fence post construction.
FIG. 18 is a fragmentary side view of an upper end of a relatively lighter gauge fence post construction according to the present invention with a mesh fence construction being attached to the fence post construction at an upper notch arrangement in anterior adjacency to the fence post construction with wing arms being bent to lock the mesh fence construction to the fence post construction.

Comparatively referencing FIGS. 15 and 16 versus FIGS. 17 and 18, it will be seen that the wing portions 17 in FIGS. 15 and 16 comprise a heavier gauge material or material construction having a greater thickness as compared to the wing portions 17 depicted in FIGS. 17 and 18. The bent portions of the upper and lower wing arms 28 and 29 as at bends 109 are formed in the reduced thickness material as further comparatively depicted in FIG. 14, which latter depiction depicts end views of (a) an upper fence post construction 10 having or being formed from a relatively heavier gauge material, and (b) a lower fence post construction 10 having or being formed from a relatively lighter gauge material.

Figure 4:
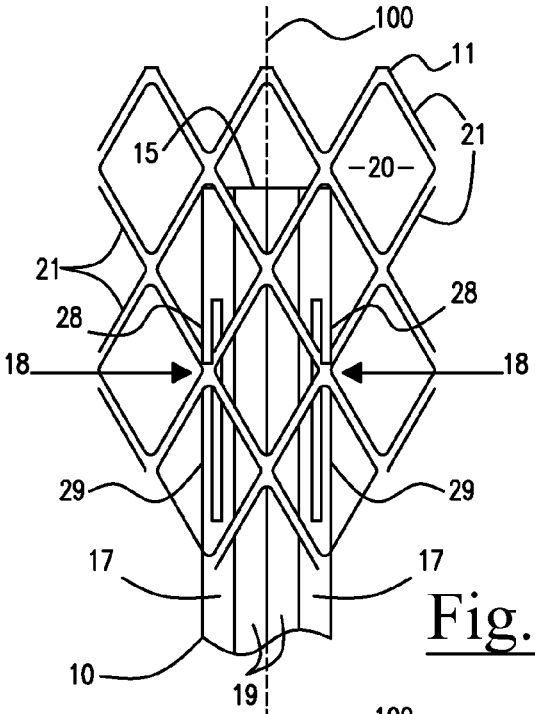
FIG. 4 is a second enlarged, fragmentary, elevational view of an upper portion of a fence post construction at an upper notch or slot arrangement site of the fence post construction, the view being presented in tandem with FIG. 5 to depict an upper end of the fence post construction being outfitted with an actuated portion of the mesh fence construction at the upper notched arrangement site.

The intertwined linkages as exemplified by linkages 21 in FIGS. 4-7 of the mesh fence construction 11 preferably comprise sufficient elasticity or resilience to enable the user to temporarily deform or actuate the select intertwined linkages 21 at the site(s) of the notch arrangements 18 (as generally depicted in FIG. 4) for enabling the user to thread the intertwined linkages 21 through or into the notch arrangements 18 via the stem portion 27. The inherent elasticity or resilience of the intertwined linkages 21 returns the select intertwined linkages 21 to a relaxed form (as generally and comparatively depicted in FIG. 6) that effectively secures the mesh fence construction 11 to the fence post construction(s) 10.

Figure 5:
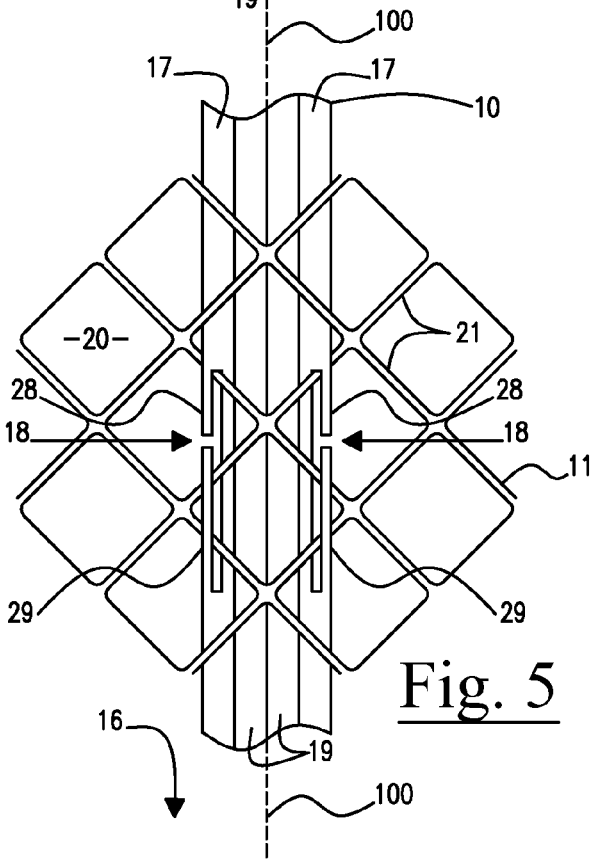
FIG. 5 is a third enlarged, fragmentary, elevational view of a lower portion of a fence post construction at a lower notch or slot arrangement site of the fence post construction, the view being presented in tandem with FIG. 4 to depict a lower end of the fence post construction having been previously outfitted with a relaxed portion of mesh fence construction at the lower notched arrangement site.

Comparatively referencing FIGS. 4 and 5, it will be seen that the mesh fence construction 11 may be first secured to a first select notch arrangement 18 (e.g. a notch arrangement 18 adjacent the lower post end 16 as generally depicted in FIG. 5), which secured attachment provides an anchor point for enabling the user to actuate the mesh fence construction 11 via the intertwined linkages 21 at a second notch arrangement longitudinally or axially spaced from the first select notch arrangement 18 (e.g. a notch arrangement 18 adjacent the upper post end 15 as generally depicted in FIG. 4).

Figure 6:
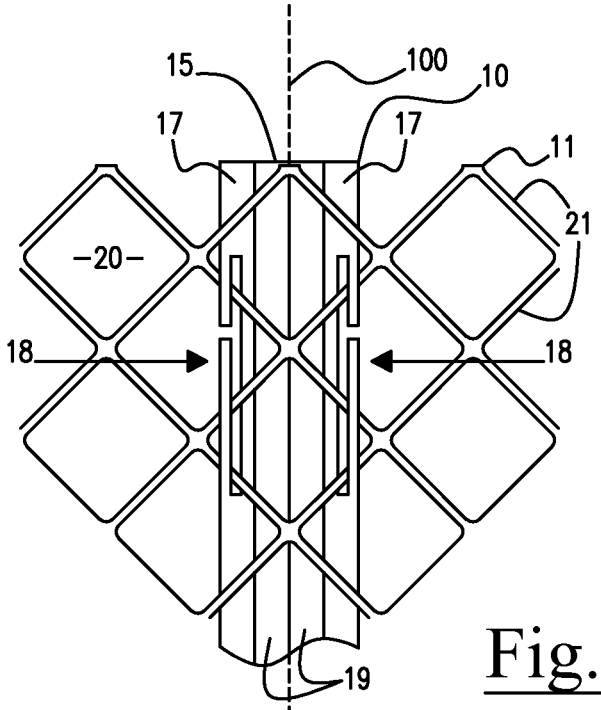
FIG. 6 is a fourth enlarged, fragmentary, elevational view of an upper portion of a fence post construction at an upper notch or slot arrangement site of the fence post construction, the view being presented in tandem with FIG. 7 to depict the upper end of the fence post construction having been outfitted with a relaxed portion of the mesh fence construction at the upper notched arrangement site.
Figure 7:
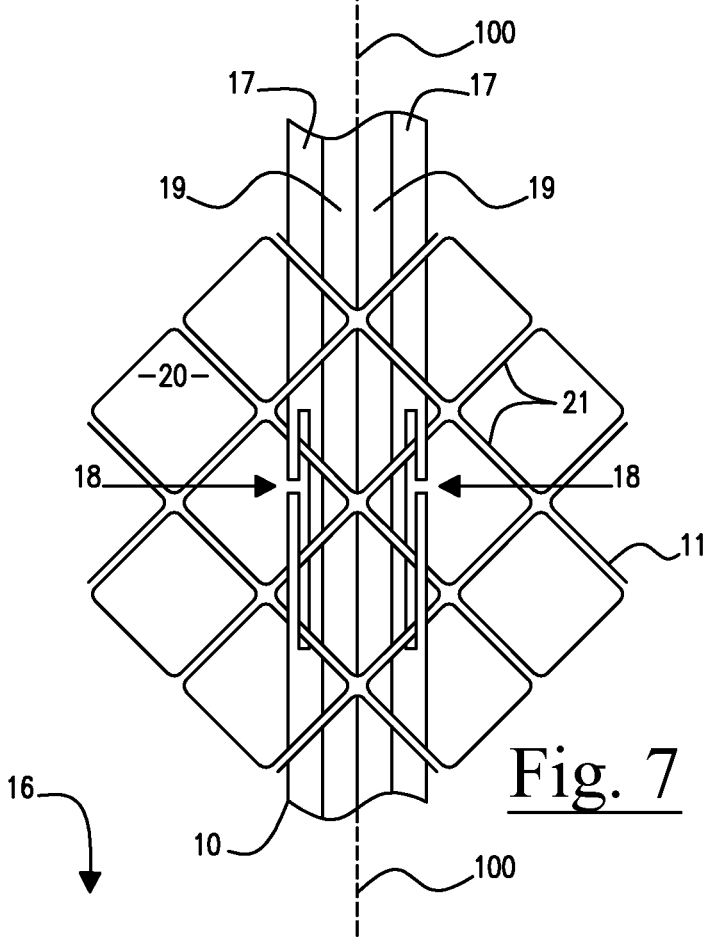
FIG. 7 is a fifth enlarged, fragmentary, elevational view of a lower portion of a fence post construction at a lower notch or slot arrangement site of the fence post construction, the view being presented in tandem with FIG. 6 to depict the lower end of the fence post construction having been previously outfitted with a relaxed portion of mesh fence construction at the lower notched arrangement site.
Figure 8:
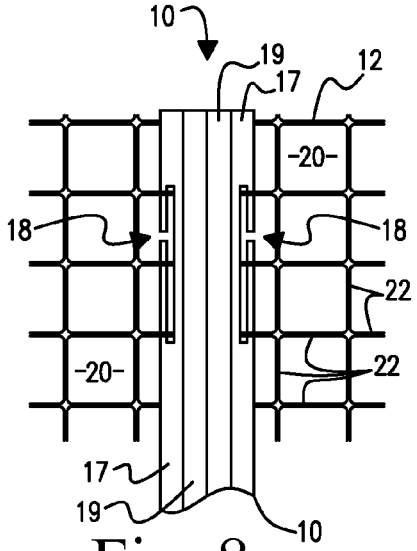
FIG. 8 is a fragmentary, elevational, posterior view of an upper portion of a fence post construction at an upper notch or slot arrangement site of the fence post construction, the view being presented in tandem with FIGS. 9-11 to depict a first alternative mesh fence construction being attached to fence post construction via the upper notch arrangement.
Figure 9:
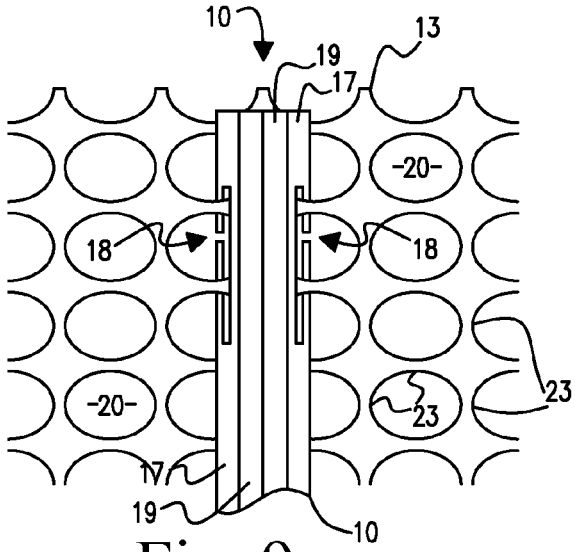
FIG. 9 is a fragmentary, elevational, posterior view of an upper portion of a fence post construction at an upper notch or slot arrangement site of the fence post construction, the view being presented in tandem with FIGS. 8, 10 and 11 to depict a second alternative mesh fence construction being attached to fence post construction via the upper notch arrangement.
Figure 10:
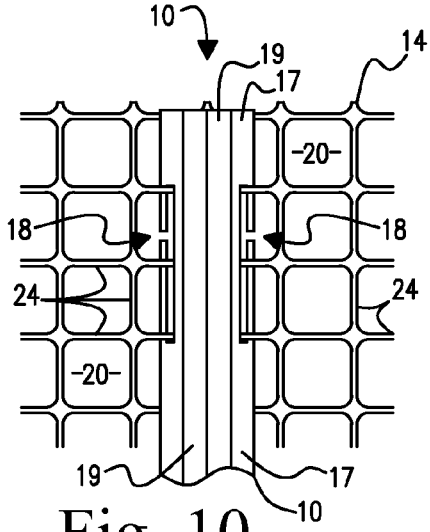
FIG. 10 is a fragmentary, elevational, posterior view of an upper portion of a fence post construction at an upper notch or slot arrangement site of the fence post construction, the view being presented in tandem with FIGS. 8, 9, and 11 to depict a third alternative mesh fence construction being attached to fence post construction via the upper notch arrangement.
Figure 11:
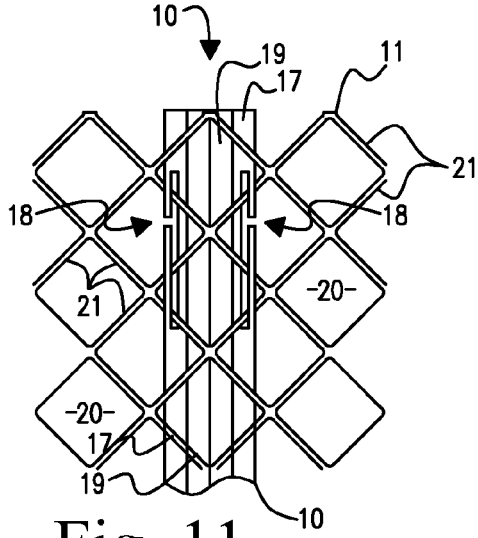
FIG. 11 is a fragmentary, elevational, anterior view of an upper portion of a fence post construction at an upper notch or slot arrangement site of the fence post construction, the view being presented in tandem with FIGS. 8-10 to depict a fourth alternative mesh fence construction being attached to fence post construction via the upper notch arrangement.

Comparatively referencing FIGS. 4 and 5 versus FIGS. 6 and 7, it will be seen that the mesh fence construction 11 may be secured to the first and second select notch arrangements 18 otherwise depicted in FIGS. 4 and 5 by relaxing or returning the actuated intertwined linkages 21 shown in FIG. 4 to a relaxed configuration shown or depicted in FIG. 6. The linkages 21 seat in the lower notch portion 26 and extend through the upper notch portion 25 and the upper and lower wing arms 28 and 29 prevent anterior and posterior movement of the linkages 21 when the linkages are so arranged thereby securing the mesh fence construction to the fence post construction(s) 10 and avoiding the requirement of additional hardware type or tie type fastening means to secure the mesh fence construction 11 to the fence post construction 10.

Figure 13:
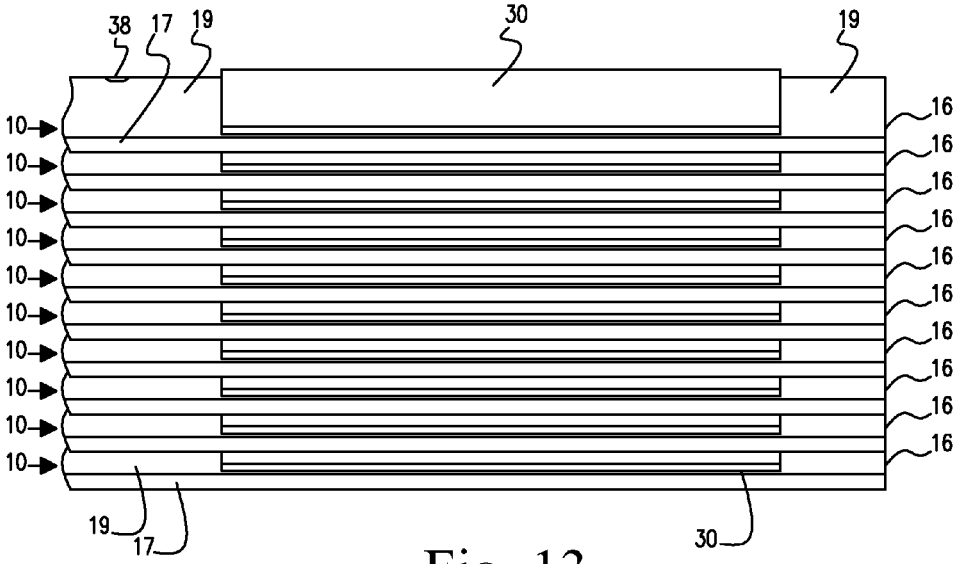
FIG. 13 is a fragmentary side elevational view of a series of stacked fence constructions according to the present invention.

Other notable attributes of the subject invention include a stackable feature of a plurality of fence post constructions 10 as generally and comparatively depicted in FIGS. 12 and 13. In other words, the fence post constructions 10 are horizontally stackable such that upper medial post portions 31 seat down upon lower medial post portions 32, the transversely triangular configurations operating to center upper medial post portions 31 upon the lower medial post portions 32. It will be noted that the optional anchor plates 30 preferably assume a similar transverse form as compared to the fence post constructions 10 so that the stackable or nesting feature may be accommodated.

Further, it is contemplated that the fence post system according to the present invention may preferably comprise, in combination, certain post-removal means for selectively removing the fence post constructions 10. In this regard, the post-removal means may be exemplified by the employment of a lever apparatus as at 33. The lever apparatus 33 according to the present invention may preferably comprise a cylindrical fulcrum portion as at 34, a first lever arm portion as at 35, and a second lever arm portion as at 36, which lever arm portions 35 and 36 (radially) extend from the fulcrum portion 34.

Figure 19:
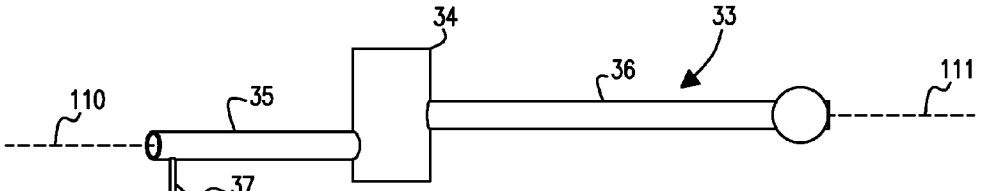
FIG. 19 is a top plan view of a lever apparatus usable in connection with the fence post construction according to the present invention.
Figure 21:
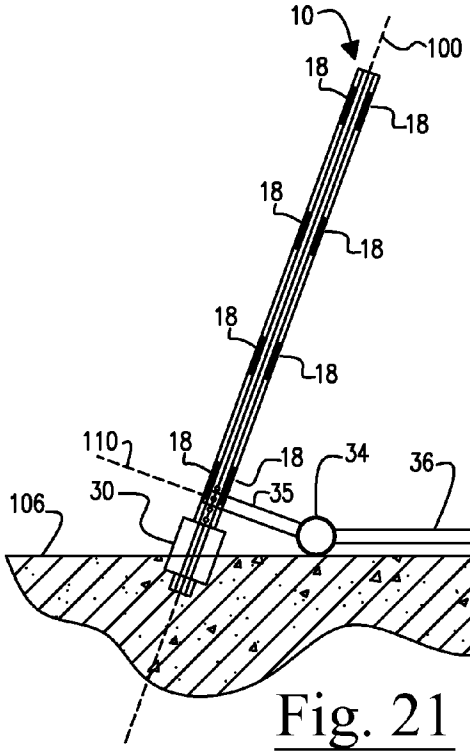
FIG. 21 is a second diagrammatic sequential depiction of a user forcing a fence post construction according to the present invention from a ground material via the lever apparatus otherwise depicted in FIG. 19.
Figure 20:
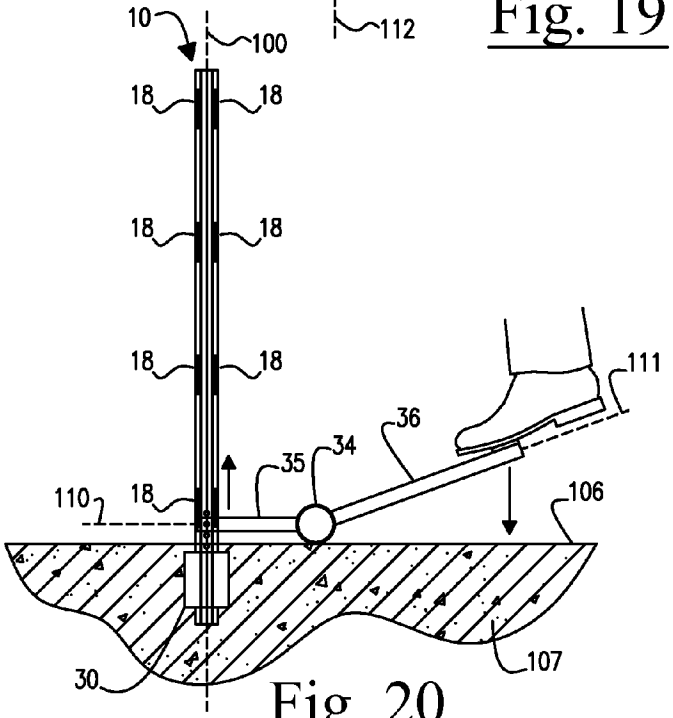
FIG. 20 is a first diagrammatic sequential depiction of a user about to force a fence post construction according to the present invention from a ground material via the lever apparatus otherwise depicted in FIG. 19.

The first and second lever arm portions 35 and 36 respectively have lever arm axes as at 110 and 111. The first lever arm portion 35 preferably comprises a post-engaging pin as at 37, which post-engaging pin 37 has a pin axis as at 112. The first lever arm axis 110 and the pin axis 112 are preferably orthogonal to one another. The post-engaging pin 37 is insertable into pin-receiving apertures as at 38 preferably formed in the medial post portions of the fence post constructions 10 adjacent the lower post ends 16. The post-engaging pin 37 transfers force directed into and through the first and second lever arm portions 35 and 36 via the fulcrum portion 37 into the fence post constructions 10 for removing the same from the ground surface 106 as generally and comparatively depicted in FIGS. 19-21.

While the foregoing specifications set forth much specificity, the same should not be construed as setting forth limits to the invention but rather as setting forth certain preferred embodiments and features. For example, as prefaced hereinabove, it is contemplated that the present invention essentially provides a fence post construction as at 10 for supporting mesh type fencing. The fence post construction according to the present invention preferably comprises or is constructed from a load bearing material and has a post axis, an upper post end, and a lower post end.

The load bearing material is preferably formed to comprise laterally opposed wing portions that extend outwardly relative to the post axis, each of which laterally opposed wing portions preferably comprise at least one notch or slot arrangement. The fence post construction is insertable into a ground surface via the lower post end such that the post axis extends in non-parallel or preferably or ideally orthogonal relation to the ground surface. A mesh fence construction is thereby attachable to the fence post construction via notch or slot arrangements.

The notch arrangements are preferably laterally and spatially paired, and spatially located or situated adjacent at least a select post end, the select post end being selected from the group consisting of the upper post end and the lower post end. The load bearing material is further preferably formed so as to comprise a medial post portion, which medial post portion interconnects the laterally opposed wing portions. The medial post portion may preferably transversely interconnect the laterally opposed wing portions non-linearly.

In this last regard, it is contemplated that the laterally opposed wing portions extend in a wing plane and the medial post portion may preferably comprise a two-portion structure or form. The two portions or structures or formations of the two-portion structure or form extend in a portion plane, which portion planes together with the wing plane preferably define a transversely triangular configuration via the planar junction sites thereof. The triangular configuration comprises an interior angle of 90 degrees.

The primary fence post construction, when juxtaposed adjacent at least one secondary, identical fence post construction, is horizontally stackable therewith such that an upper medial post portion may seat down upon a lower medial post portion within the stack. The transversely triangular configurations of the fence post constructions effectively operate to center the upper medial post portion(s) upon the lower medial post portion(s).

Each notch or slot arrangement is characteristically and preferably T-shaped. The T-shaped notch or slot arrangements thereby provide a downwardly extending upper wing arm and an upwardly extending lower wing arm. The load bearing material of the fence post construction may preferably comprise a sufficient gauge or thickness to enable the user to manually (i.e. with one's finger or proper tool or implement) bend a select wing arm to lock intertwined linkages of the mesh type fence to the fence post construction(s), the select wing arm being selected from the group consisting of the upper and lower wing arms.

The T-shaped notch or slot arrangements each further preferably comprise an upper notch portion, a lower notch portion collinear with the upper notch portion, and a stem notch portion orthogonal to the upper and lower notch portions. The lower notch portion is preferably at least twice the length of the upper notch portion relative to the stem portion. The upper and lower notch portions each further preferably comprise a substantially uniform notch width and the stem portion comprises a stem opening width, wherein the stem opening or entry width is preferably greater than the notch width.

Further, it is contemplated that the structures described herein inherently support certain fence posting methodology for post-supporting mesh fencing. Accordingly, it is believed that certain fence posting methods are supported by the foregoing specifications, and may be said to preferably comprise the initial step of providing at least one fence post construction, the fence post construction comprising a post axis, an upper post end, a lower post end, and at least one notched arrangement. The at least one wing portion is then into a ground surface via the post lower end such that the post axis extends in non-parallel relation to the ground surface; and a mesh fence construction is attachable to the at least one fence post construction via the notched arrangement.

Each notch arrangement may be preferably T-shaped such that the T-shaped notch arrangements thereby further provide a downwardly extending upper wing arm and an upwardly extending lower wing arm. The mesh fence construction is thus attachable to the at least one fence post construction via an engagement with the upper and lower wing arms. The method may be said to further comprise the step of bending a select wing arm to lock intertwined linkages of the mesh fence construction to the at least one fence post construction, the select wing arm being selected from the group consisting of the upper and lower wing arms. Still further, the fence posting method may be said to comprise the steps of (a) actuating intertwined linkages of the mesh fence construction and (b) relaxing intertwined linkages of the mesh fence construction during the step of attaching the mesh fence construction to the at least one fence post construction via the notched arrangement.

Accordingly, although the invention has been described by reference to certain preferred and alternative embodiments and certain methodologies associated therewith, it is not intended that the novel arrangements and methods be limited thereby, but that modifications thereof are intended to be included as falling within the broad scope and spirit of the foregoing disclosures and the appended drawings.

I claim:

1. A fence post system for providing notch-supported mesh fencing, the fence post system comprising, in combination:

a plurality of fence post constructions, each fence post construction being constructed from a load bearing material and having a post axis, an upper post end, and a lower post end, the load bearing material being formed to comprise:

a medial post portion comprising a non-linear cross section at least partially offset laterally from the post axis, and comprising opposing first and second lateral edges, a pair of opposing, coplanar wing portions extending radially outwardly relative to the post axis and each connected to a respective one of the opposing first and second lateral edges of the medial post portion, each wing portion comprising at least one notch arrangement including:

a stem portion extending from an outer edge of the wing portion towards the post axis, an upper notch portion extending substantially upwardly from an inner end of the stem portion, such that an upper wing arm is formed between the upper notch portion and the outer edge; and a lower notch portion extending substantially downwardly from the inner end of the stem portion, such that a lower wing arm is formed between the upper notch portion and the outer edge; and a mesh fence construction, the mesh fence construction comprising a mesh height, a mesh length, and a series of intertwined linkages, the intertwined linkages together defining a number of openings therebetween, the fence post constructions being insertable into a ground surface in spaced relation to one another via the lower post ends such that the post axes extend in non-parallel relation to the ground surface, the mesh fence construction being attachable to the fence post constructions in spaced relation along the mesh length, select intertwined linkages being received and secured within the notch arrangements such that a first linkage of the mesh fence construction is at least partially secured against removal within each upper notch portion by the respective upper wing arm, a second linkage of the mesh fence construction is at least partially secured against removal within each lower notch portion by the respective lower wing arm, and the mesh height extends in substantially parallel relation to the post axes, the fence post constructions and mesh fence construction thereby providing notch-supported mesh fencing materials.

2. The fence post system of claim 1 wherein each fence post construction comprises laterally opposed wing portions, each laterally opposed wing portion comprising a respective notch arrangement.

3. The fence post system of claim 2 wherein the respective notch arrangements are laterally and spatially paired with one another, and wherein the mesh fence construction is secured by both respective notch arrangements.

4. The fence post system of claim 3 wherein the laterally opposed wing portions extend in a wing plane, each medial post portion comprising a two-portion structure, each portion of the two-portion structure extending in a portion plane, the portion planes and the wing plane defining a transversely triangular configuration via planar junction sites thereof.

5. The fence post system of claim 4 wherein the fence post constructions are horizontally stackable such that upper medial post portions seat down upon lower medial post portions, the transversely triangular configurations operating to center upper medial post portions upon the lower medial post portions.

6. The fence post system of claim 1 wherein each notch arrangement is T-shaped.

7. The fence post system of claim 6 wherein the load bearing material enables a user to manually bend a select wing arm to lock select intertwined linkages to the fence post constructions, the select wing arm being selected from the group consisting of the upper and lower wing arms.

8. The fence post system of claim 1 wherein select intertwined linkages of the mesh fence construction comprise sufficient resilience to enable a user to temporarily actuate said select intertwined linkages at select notch arrangements for enabling the user to thread select intertwined linkages through the notch arrangements, said resilience returning the select intertwined linkages to a relaxed form that effectively secures the mesh fence construction to the fence post constructions.

9. The fence post system of claim 1 further comprising, in combination, post-removal means for selectively removing the fence posts.

10. The fence post system of claim 9 wherein the post-removal means employ a lever apparatus, the lever apparatus comprising a fulcrum portion and first and second lever arm portions extending from the fulcrum portion, the first and second lever arm portions respectively having lever arm axes, the first lever arm portion comprising a post-engaging pin, the post-engaging pin having a pin axis, the first lever arm axis and the pin axis being orthogonal, the post-engaging pin being engageable with pin-receiving apertures formed in the fence post constructions adjacent the post lower ends, the post-engaging pin for transferring force directed into and through the first and second lever arm portions via the fulcrum portion into the fence post constructions for removing the same from the ground surface.

11. The fence post construction of claim 1 wherein the lower notch portion and lower wing arm are at least twice the length of the upper notch portion and upper wing arm relative to the stem portion.

12. A fence posting method for post-supporting mesh fencing, the fence posting method comprising the steps of:

providing at least one fence post construction, the fence post construction comprising a post axis, an upper post end, a lower post end, and further comprising:

a medial post portion comprising a non-linear cross section at least partially offset laterally from the post axis and comprising opposing first and second lateral edges;

a pair of opposing, coplanar wing portions extending radially outwardly from the post axis and each connected to a respective one of the opposing first and second lateral edges of the medial post portion, each wing portion comprising at least one notched arrangement including:

a stem portion extending from an outer edge of the wing portion towards the post axis, an upper notch portion extending substantially upwardly from an inner end of the stem portion, such that an upper wing arm is formed between the upper notch portion and the outer edge; and a lower notch portion extending substantially downwardly from the inner end of the stem portion, such that a lower wing arm is formed between the upper notch portion and the outer edge;

inserting the lower post end into a ground surface such that the post axis extends in non-parallel relation to the ground surface; and attaching first and second mesh fence linkages of a mesh fence construction to the at least one fence post construction such that the first linkage is at least partially secured against removal within each upper notch portion by the respective upper wing arm, and the second linkage is at least partially secured against removal within each lower notch portion by the respective lower wing arm.

13. The fence posting method of claim 12 wherein each notch arrangement is T-shaped.

14. The fence posting method of claim 13 comprising the step of bending a select wing arm to lock intertwined linkages of the mesh fence construction to the at least one fence post construction, the select wing arm being selected from the group consisting of the upper and lower wing arms.

15. The fence posting method of claim 13 comprising the steps of actuating intertwined linkages of the mesh fence construction and relaxing intertwined linkages of the mesh fence construction during the step of attaching the mesh fence construction to the at least one fence post construction via the notched arrangement.

* * * * *